US006598239B1

(12) United States Patent
Hsieh

(10) Patent No.: US 6,598,239 B1
(45) Date of Patent: Jul. 29, 2003

(54) DRAINING STRUCTURE FOR DIVING MASK

(76) Inventor: Hsing-Chi Hsieh, No.51, Wan An Street, Taipei (TW)

( * ) Notice: Subject to any disclaimer, the term of this patent is extended or adjusted under 35 U.S.C. 154(b) by 0 days.

(21) Appl. No.: 10/340,249

(22) Filed: Jan. 9, 2003

(51) Int. Cl.[7] ..... A61F 9/02
(52) U.S. Cl. ..... 2/428; 128/200.29
(58) Field of Search ..... 2/428, 430, 446, 2/429; 128/206.15, 200.29

(56) References Cited

U.S. PATENT DOCUMENTS 5,329,643 A * 7/1994 Sato ..... 2/428
5,479,917 A * 1/1996 Hsieh ..... 128/200.29
5,558,466 A * 9/1996 Kuo et al. ..... 405/186
5,564,130 A * 10/1996 Feng ..... 2/428
5,890,234 A * 4/1999 Lan ..... 2/428
5,979,441 A * 11/1999 Hsieh ..... 128/201.28

* cited by examiner

*Primary Examiner*—John J. Calvert
*Assistant Examiner*—Katherine Moran
(74) *Attorney, Agent, or Firm*—Pro-Techtor International Services

(57) ABSTRACT

A draining structure for diving mask includes a soft head cover fixedly connected to a rigid skirt framing a lens. The soft head cover includes a forward projected nose portion having a draining valve provided at a bottom thereof to be openable only in an outward direction. A draining guide is provided below the nose portion and has a hole formed directly below the draining valve to prevent water from sideward flushing open the draining valve when a diver jumps into water in a vertical position. An upward projected flange is provided at a rear end of the draining guide to guide air bubbles produced by the diver's expiration to two side outlets of the draining guide. The flange also reinforces the two side outlets and prevents them from deformation when the head cover is put on the diver's head and presses against the side outlets.

1 Claim, 5 Drawing Sheets

DRAINING STRUCTURE FOR DIVING MASK

FIELD OF THE INVENTION

The present invention relates to a draining structure for a diving mask, and more particularly to a draining structure for a diving mask that is able to drain off water accumulated in the diving mask via two side outlets at a rear end of the diving mask, to prevent water from sideward flushing open a valve leaf and entering the diving mask, and to protect the side outlets from deformation when the diving mask is put on a diver's head.

BACKGROUND OF THE INVENTION

A diving mask typically includes a rigid skirt framing a lens, and a soft head cover fixedly connected to the rigid skirt for putting on a diver's head. Since the head cover does not always fit with the diver's head contour, there are frequently clearances left between the diving mask and the diver's face, resulting in invasion of water into the diving mask to interfere with the diver's face or even seriously affecting the diver's breath and vision. It is therefore necessary to timely drain off water accumulated in the diving mask.

A common way to drain off water accumulated in the diving mask is to mount a valve leaf to a bottom of a forward projected nose portion of the diving mask, so as to provide a draining valve for the diving mask. The draining valve is a one-way valve that allows the valve leaf to open only in an outward direction, so that water accumulated in the diving mask could be drained off via the valve leaf while external water is prevented from entering the diving mask via the valve leaf. The diver needs only to expire via nose to blow the accumulated water out of the diving mask via the outward openable valve leaf.

Gas expired by the diver produces air bubbles in the drained water. Since the draining valve is provided below the nose portion at a central bottom of the diving mask, the air bubbles in the drained water tend to move upward in front of the diving mask and seriously interfere with the diver's vision.

To overcome this problem, there is developed a draining structure provided at the bottom of the nose portion of the diving mask to guide the air bubbles produced by the diver's expiration to two lateral sides of the diving mask, so that they do not interfere with the diver's vision.

FIGS. 1 to 4 shows a conventional diving mask and associated draining structure disclosed in U.S. Pat. No. 5,860,168. Wherein, FIG. 1 is a sectioned side view of the conventional diving mask, FIG. 2 is a partially sectioned front view thereof, FIG. 3 is a side view of the conventional diving mask before being worn by a diver, and FIG. 4 is a fragmentary side view of the same diving mask after being worn by a diver.

As shown in FIGS. 1 to 4, the conventional diving mask, which is generally denoted by letter A, includes a rigid skirt 1 framing a lens 11, and a soft head cover 2 fixedly connected to the rigid skirt 1. The soft head cover 2 includes a forward projected nose portion 21. A valve seat 24 having a through hole 23 is mounted on a bottom 22 of the nose portion 21. A valve leaf 25 is mounted on the valve seat 24 to locate below the through hole 23. The valve leaf 25 can be opened in an outward direction only, and normally closes the through hole 23 to prevent external water from invading the diving mask A via the through hole 23. When a diver wearing the diving mask A expires via his or her nose, the valve leaf 25 is blown outward to open the through hole 23, allowing any water accumulated in the diving mask A to be drained off.

A curved draining guide 26 downward extends from a lower front end of the nose portion 21 by a predetermined distance and then turns rearward to extend toward two sides of the soft head cover 2, such that a water passage 27 is formed between the bottom 22 of the nose portion 21 and the draining guide 26 to extend rearward and sideward. When the diver expires to drain off the accumulated water, air bubbles produced in the drained water by the diver's expiration are guided through the water passage 27 to two sides of the diving mask to avoid interfering with the diver's vision in front of the diving mask.

Following drawbacks are found in the above-described conventional diving mask A:

1. As shown in FIG. 1, the curved draining guide 26 is located below the valve leaf 25 such that a wide transverse opening 28 is formed between the draining guide 26 and a rear end of the bottom 22 of the nose portion 21. When a diver wearing the conventional diving mask A jumps into water in a vertical position, an instantaneous high water pressure produced at the instant of contact of the diving mask A with water surface will flow into the water passage 27 via the wide transverse opening 28 to impact on one side of the valve leaf 25 to open the valve leaf 25 and accordingly the through hole 23, allowing external water to instantaneously invade the diving mask A, as indicated by the arrow "a" in FIG. 1, and accumulate in the diving mask A.
2. Since the water instantaneously accumulated in the diving mask A must be quickly drained to avoid any adverse influence on the diver's normal breath, the diver has to expire as soon as he or she starts diving. This is, of course, very inconvenient to the diver.
3. As shown in FIG. 2, the conventional diving mask A is designed to guide air bubbles produced in the drained water by the diver's expiration to two lateral sides of the diving mask via the water passage 27, as indicated by arrows "b" in FIG. 2. However, a part of the air bubbles would pass the wide transverse opening 28 between the rear ends of the bottom 22 of the nose portion and the draining guide 26 to move through the bottom to the front of the diving mask A, as indicated by the arrow "c" in FIG. 1, and interfere with the diver's vision.
4. As shown in FIG. 3, there is a proper space left between two side outlets 29 of the water passage 27 and two lateral edges of the soft head cover 2 when the diving mask A is not worn by a diver. The side outlets 29 of the water passage 27 are, however, deformed and narrowed when the soft head cover 2 is put on the diver's head and stretched out wardly to compress against the side outlets 29, preventing the air bubbles from smoothly moving out of the water passage 27 via the side outlets 29. This would cause more air bubbles to move toward and release from the wide transverse opening 28, and finally move through the bottom to the front of the diving mask A, as indicated by the arrow "c" in FIG. 1, and seriously interfere with the diver's vision.

SUMMARY OF THE INVENTION

It is therefore a primary object of the present invention to provide an improved draining structure for diving masks to eliminate the drawbacks existing in the conventional structure by guiding the air bubbles produced by the diver's expiration to two lateral sides of the diving mask, preventing the valve leaf from being sideward opened, and protecting the water passage against deformation when the soft head cover is put on the diver's head.

To achieve the above and other objects, the diving mask of the present invention includes a rigid skirt framing a lens, and a soft head cover fixedly connected to the rigid skirt. The soft head cover includes a forward projected nose portion. A valve seat having a through hole is mounted on a bottom of the nose portion. A valve leaf is mounted on the valve seat below the through hole. The valve leaf can be opened in an outward direction only. The valve leaf normally closes the through hole to prevent external water from invading the diving mask via the through hole. When a diver wearing the diving mask expires via his or her nose, the valve leaf is blown outward to open the through hole, allowing any water accumulated in the diving mask to be drained off.

A curved draining guide extending downward from a lower front end of the nose portion by a predetermined distance and then turns rearward to extend toward two sides of the soft head cover, such that a water passage is formed between the bottom of the nose portion and the draining guide to extend rearward and sideward.

The draining guide of the present invention is characterized by a hole located directly below the valve leaf. When a diver wearing the diving mask of the present invention jumps into water in a vertical position, an instantaneous water pressure produced at the instant of contact of the diving mask with water surface will fully act on a bottom side of the valve leaf via the hole on the draining guide to therefore further push the valve leaf upward to tightly close the through hole on the valve seat without the problem of sideward opening of the valve leaf.

The draining guide of the present invention is also characterized by an upward projected transverse flange provided along a rear end of the water passage to reduce a vertical openness of a transverse opening at a rear end of the water passage and to intercept air bubbles produced by the diver's expiration at the transverse opening, lest the air bubbles should move through the bottom to the front of the diving mask to interfere with the diver's vision.

The flange provided along the rear end of the water passage also reinforces the water passage at the transverse opening, so that the two side outlets of the water passage have increased compression strength and are not deformed and narrowed by the head cover when the latter is put on the diver's head and outward stretched to press against the side outlets, allowing the air bubbles to smoothly and quickly move out of the diving mask via the side outlets.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
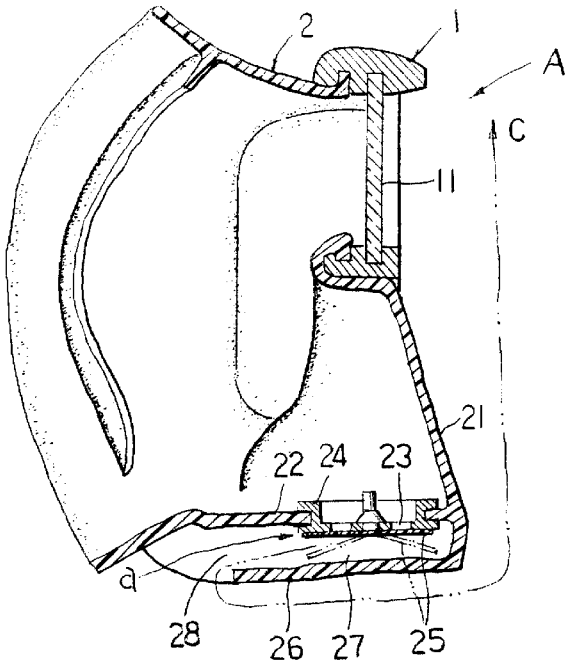
FIG.1 (Prior Art)
FIG. 1 is a sectioned side view of a conventional diving mask.
Figure 2:
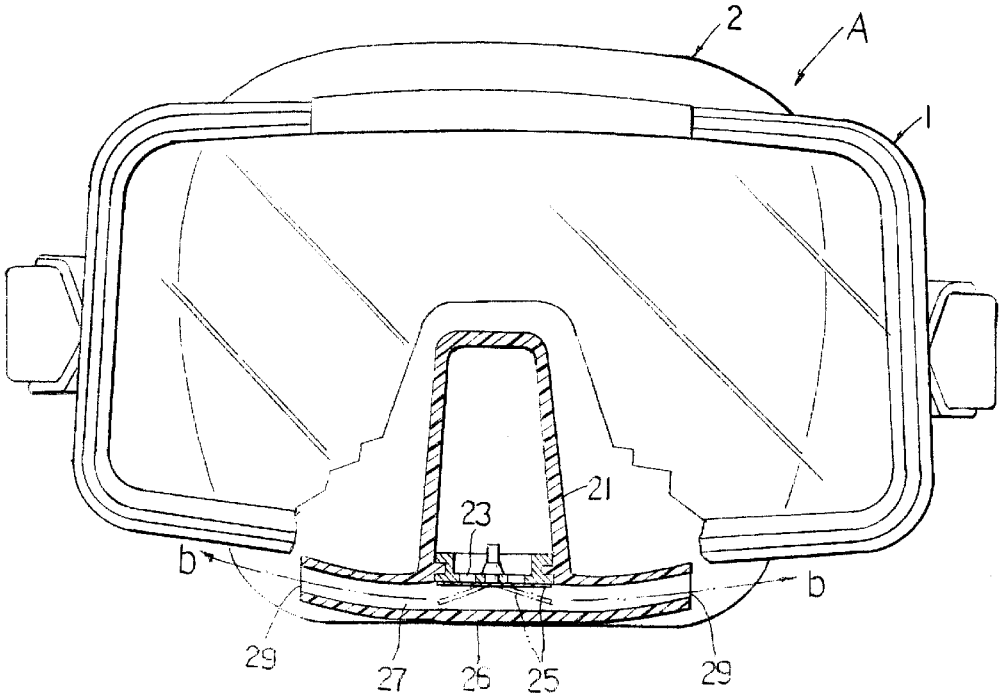
FIG.2 (Prior Art)
FIG. 2 is a partially sectioned front view of the conventional diving mask of FIG. 1.
Figure 3:
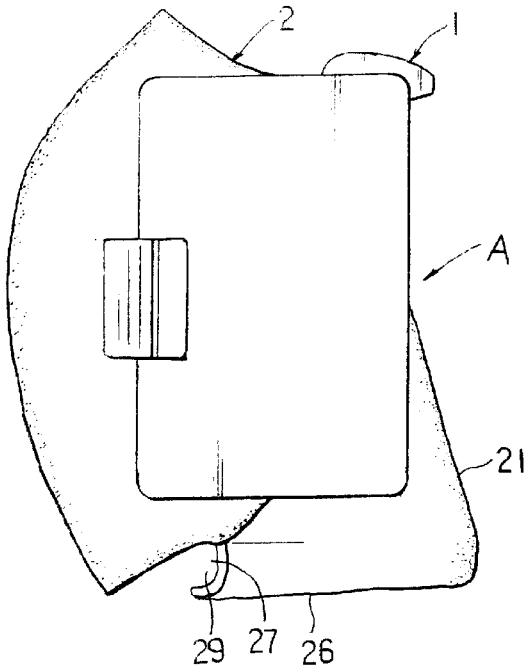
FIG. 3 (Prior Art)
FIG. 3 is a side view of the conventional diving mask of FIG. 1 before being worn by a diver.
Figure 4:
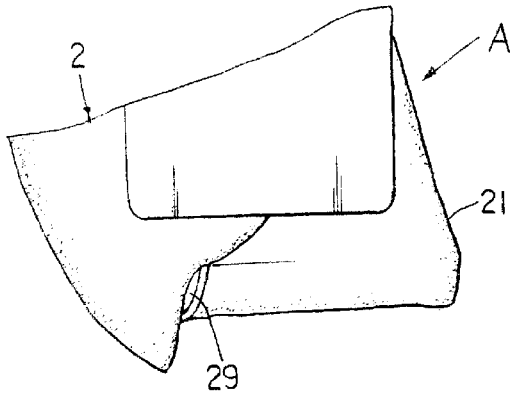
FIG. 4 (Prior Art)
FIG. 4 is a fragmentary side view of the conventional diving mask of FIG. 1 when being worn by a diver.
Figure 5:
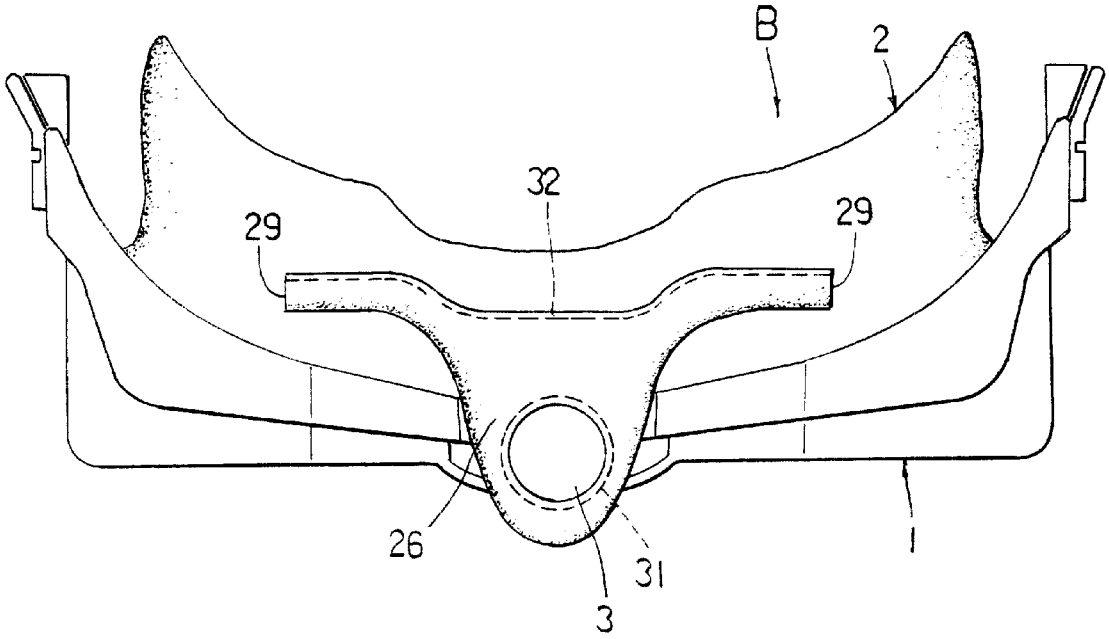
FIG. 5 is a bottom view of a diving mask according to the present invention.
Figure 6:
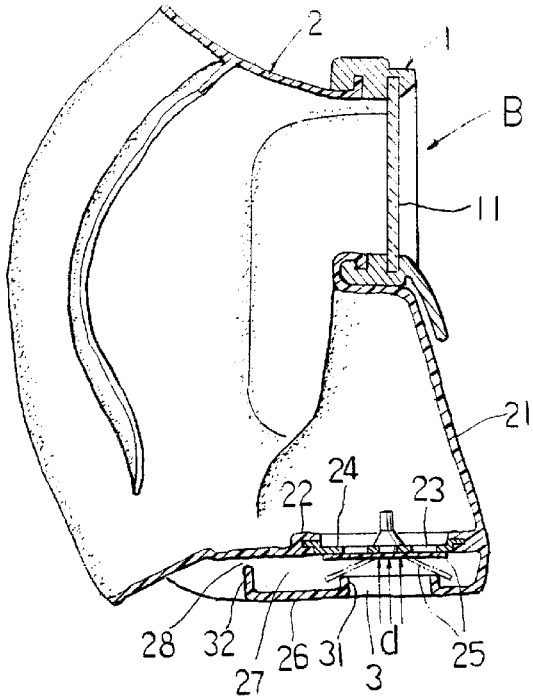
FIG. 6 is a sectioned side view of the diving mask of the present invention.
Figure 7:
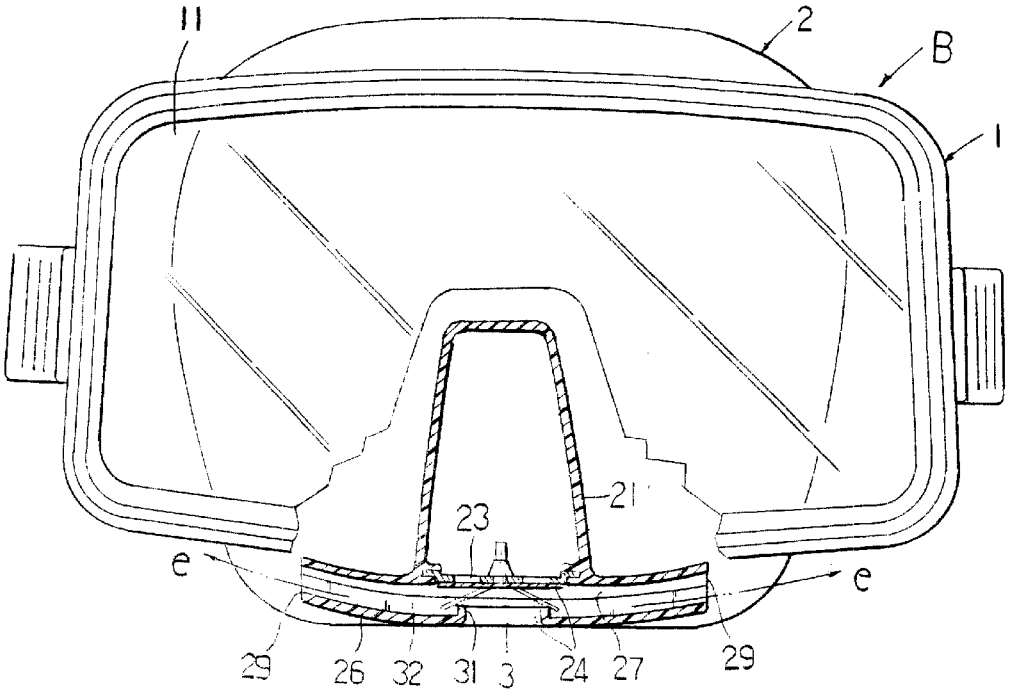
FIG. 7 is a partially sectioned front view of the diving mask of the present invention.

Please refer to FIGS. 5, 6, and 7 that are sequentially a bottom view, a sectioned side view, and a partially sectioned front view of a diving mask B according to the present invention. As shown, the diving mask B includes a rigid skirt 1 framing a lens 11, and a soft head cover 2 fixedly connected to the skirt 1. The soft head cover 2 includes a forward projected nose portion 21. A valve seat 24 having a through hole 23 is mounted on a bottom 22 of the nose portion 21. A valve leaf 25 is mounted on the valve seat 24 to locate below the through hole 23. The valve seat 24 and the valve leaf 25 together form a one-way draining valve to be opened in an outward direction only. The valve leaf 25 normally closes the through hole 23 to prevent external water from invading into the diving mask B via the through hole 23. When a diver wearing the diving mask B expires via his or her nose, the valve leaf 25 is blown outward to open the through hole 23, allowing any water accumulated in the diving mask B to be drained off.

A curved draining guide 26 downward extends from a lower front end of the nose portion 21 by a predetermined distance and then turns rearward to extend toward two sides of the soft head cover 2, such that a water passage 27 having a wide rear opening 28 and two side outlets 29 is formed between the bottom 22 and the draining guide 26. The draining guide 26 of the present invention is characterized by a hole 3 located directly below the valve leaf 25, an upward projected annular flange 31 provided along a peripheral edge of the hole 3, and an upward projected transverse flange 32 provided along a rear end of the water passage 27.

When a diver wearing the diving mask B of the present invention jumps into water in a vertical position, an instantaneous water pressure produced at the instant of contact of the diving mask B with water surface will fully act on a bottom side of the valve leaf 25 via the hole 3 on the draining guide 26, as indicated by arrows d in FIG. 6, and therefore further pushes the valve leaf 25 upward to tightly close the through hole 23 on the valve seat 24. Moreover, the transverse flange 32 at the rear end of the water passage 27 functions to retard quick invasion of a large amount of water into the water passage 27 via the wide rear opening 28 at the instant of contact of the diving mask B with water surface, and thereby stops any invaded water from sideward flushing open the valve leaf 25.

Please refer to FIGS. 6 and 7 at the same time. When there is any accumulated water to be drained off the diving mask B, the diver wearing the diving mask B may expire via nose to blow the valve leaf 25 outward to open the through hole 23, and the accumulated water in the diving mask B is blown out via the through hole 23 at the same time. It is noted the valve leaf 25 blown to the outward open position is in contact with the annular flange 31 of the hole 3 on the draining guide 26 and thereby closes the hole 3 and prevents air bubbles produced by the diver's expiration from moving out via the hole 3. Moreover, the transverse flange 32 at the rear end of the water passage 27 also functions to intercept the air bubbles at the rear opening 28 and guide them to the two side outlets 29, as indicated by arrows e in FIG. 7. As a result, no air bubble would interfere with the vision field in front of the diver.

Figure 8:
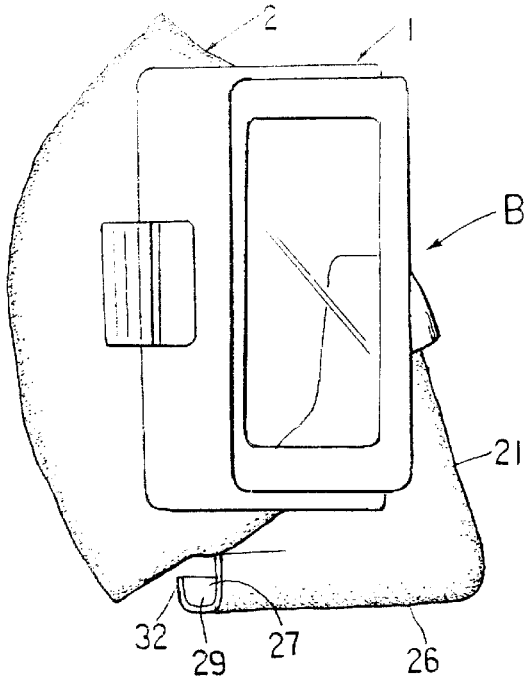
FIG. 8 is a side view of the diving mask of the present invention before being worn by a diver.
Figure 9:
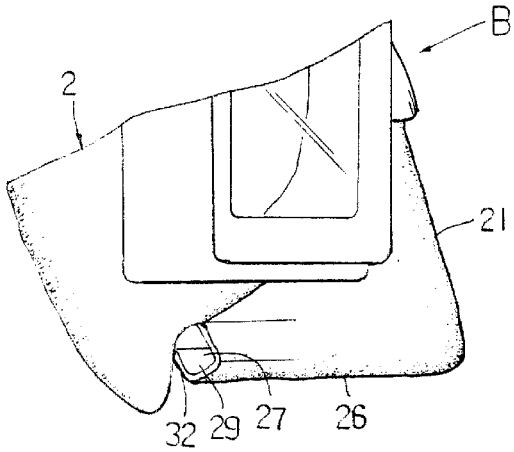
FIG. 9 is a fragmentary side view of the diving mask of the present invention when being worn by a diver.

Please refer to FIGS. 8 and 9 that are side views of the diving mask B of the present invention before and after being worn by a diver, respectively. The transverse flange 32 provided at the rear end of the water passage 27 of the draining guide 26 also has the function of reinforcing the rear end of the water passage 27. When the diving mask B is put on a diver's head, the soft head cover 2 is outward stretched and deformed to press against the two side outlets 29 of the water passage 27. However, due to the transverse flange 32, the side outlets 29 have increased compression strength and are not subjected to compression, deformation, and reduced openness, allowing the air bubbles produced by the diver's expiration to smoothly and quickly move out of the diving mask via the two side outlets 29.

What is claimed is:

1. A draining structure for diving mask, comprising:

a rigid skirt framing a lens;

a soft head cover fixedly connected to said rigid skirt and including a forward projected nose portion; said nose portion being provided at a bottom with a draining valve that includes a valve seat having a through hole, and a valve leaf mounted on said valve seat below said through hole in such a manner that said valve leaf can be opened only in an outward direction; and a curved draining guide extending downward from a lower front end of said nose portion by a predetermined distance and then turned rearward to extend toward two sides of said soft head cover, such that a water passage having a wide rear opening and two side outlets is formed between said bottom of said nose portion and said draining guide; and said draining guide being characterized by a hole located directly below said valve leaf, an upward projected annular flange provided along a peripheral edge of said hole, and an upward projected transverse flange provided along a rear end of said water passage.

* * * * *